US012599193B2

(12) United States Patent
Bramani

(10) Patent No.: US 12,599,193 B2
(45) Date of Patent: Apr. 14, 2026

(54) METHOD CONCERNING THE APPLICATION OF A SOLE OBTAINED BENDING THE EDGES OF A FLAT NON-TRIMMED SOLE ON AN UPPER FOR OBTAINING A SHOE AND A THUS OBTAINED SHOE

(71) Applicant: Vibram S.p.A., Albizzate (IT)

(72) Inventor: Marco Bramani, Albizzate (IT)

(73) Assignee: Vibram S.p.A., Albizzate (IT)

( * ) Notice: Subject to any disclaimer, the term of this patent is extended or adjusted under 35 U.S.C. 154(b) by 0 days.

(21) Appl. No.: 18/618,316

(22) Filed: Mar. 27, 2024

(65) Prior Publication Data

US 2024/0237781 A1 Jul. 18, 2024

Related U.S. Application Data

(63) Continuation of application No. 17/421,157, filed as application No. PCT/IB2019/058823 on Oct. 16, 2019, now Pat. No. 11,992,083.

(30) Foreign Application Priority Data

Jan. 8, 2019 (IT) ..... 102019000000157

(51) Int. Cl.
*A43B 13/14* (2006.01)
*A43B 9/12* (2006.01)

(52) U.S. Cl.
CPC ..... *A43B 13/148* (2013.01); *A43B 9/12* (2013.01)

(58) Field of Classification Search
CPC ..... A43B 13/148; A43B 13/14; A43B 9/12
See application file for complete search history.

(56) References Cited

U.S. PATENT DOCUMENTS 5,799,417 A * 9/1998 Burke ..... A43B 3/0047 36/105
6,205,683 B1 * 3/2001 Clark ..... A43B 13/12 36/31
6,438,868 B1 * 8/2002 Fini ..... A43B 13/12 12/146 B (Continued)

FOREIGN PATENT DOCUMENTS

DE 89 13 217 U1 3/1990
EP 1 080 651 A1 3/2001

OTHER PUBLICATIONS

International Search Report for PCT/IB2019/058823 dated Jan. 23, 2020 (6 pages).

(Continued)

*Primary Examiner* — Bao-Thieu L Nguyen
(74) *Attorney, Agent, or Firm* — Tutunjian & Bitetto, P.C.

(57) ABSTRACT

A method for coupling a non-trimmed sole and an upper for making a shoe, which includes the steps of providing a non-trimmed sole having a flat and/or sheet-like shape and provided with a first surface, adapted during use to face towards the upper, wherein the non-trimmed sole includes a central part or impression and an edge portion which is extended outward starting from a peripheral portion of the impression, positioning the sole in a position below the upper, moving the non-trimmed sole so to enclose at least part of the upper, constraining the non-trimmed sole and at least part of the upper so as to obtain the shoe; shoe obtainable by such method.

14 Claims, 7 Drawing Sheets

(56) References Cited

U.S. PATENT DOCUMENTS

| | | | | |
|---|---|---|---|---|
| 6,845,572 | B1 * | 1/2005 | Haimerl | A43B 7/125 36/12 |
| 9,707,727 | B2 * | 7/2017 | Darland | A43D 25/20 |
| 2006/0059716 | A1 * | 3/2006 | Yamashita | A43B 13/223 36/59 R |
| 2013/0047463 | A1 | 2/2013 | Menezes | |
| 2015/0068061 | A1 * | 3/2015 | Farris | A43C 5/00 36/83 |
| 2015/0201709 | A1 | 7/2015 | Jurkovic et al. | |
| 2015/0290877 | A1 * | 10/2015 | Darland | A43D 25/183 427/469 |
| 2015/0290893 | A1 * | 10/2015 | Darland | A43D 25/183 427/469 |
| 2017/0071282 | A1 * | 3/2017 | Fransko, Sr. | A43B 3/26 |
| 2017/0280823 | A1 * | 10/2017 | Langvin | A43B 9/12 |
| 2019/0350308 | A1 * | 11/2019 | Paulson | A43B 13/188 |
| 2020/0205515 | A1 * | 7/2020 | Cross | A43B 13/14 |
| 2021/0204646 | A1 * | 7/2021 | Davis | A43B 3/26 |
| 2021/0259365 | A1 * | 8/2021 | Maselino | A43C 11/008 |
| 2023/0025350 | A1 * | 1/2023 | Butler | A43C 11/22 |

OTHER PUBLICATIONS

Written Opinion for PCT/IB2019/058823 dated Jan. 23, 2020 (7 pages).

* cited by examiner

FIG. 1
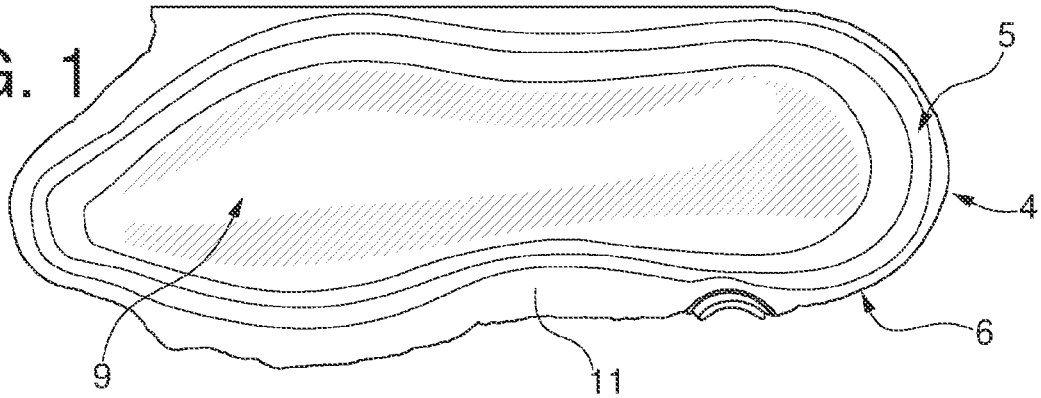
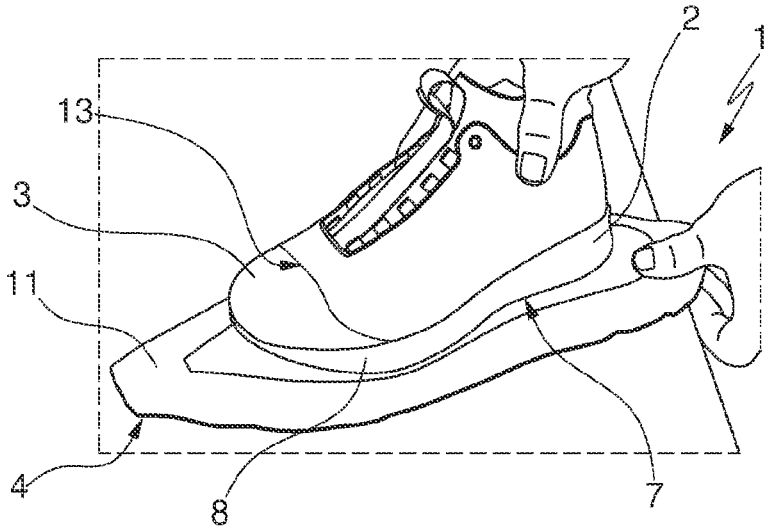
FIG. 2
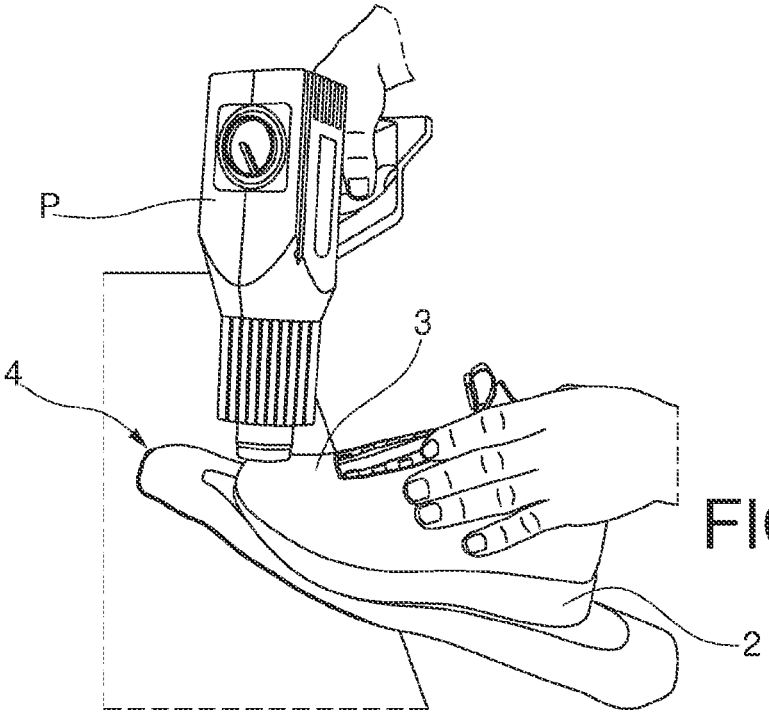
FIG. 3

FIG. 4
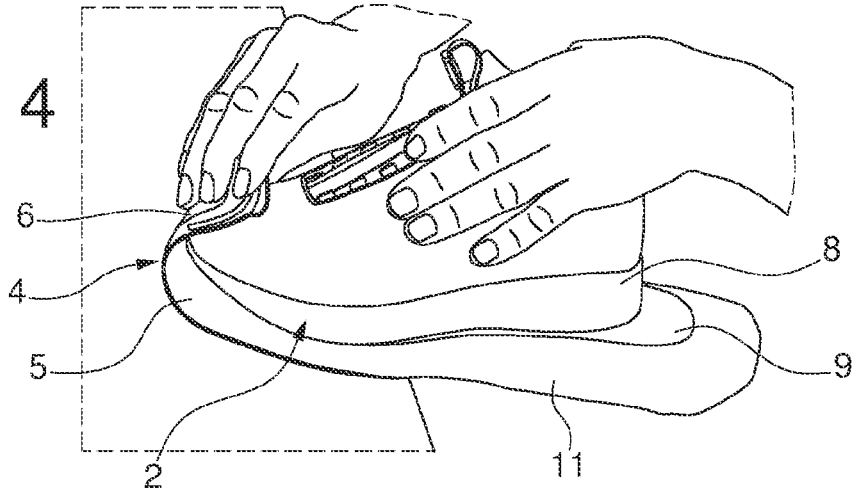
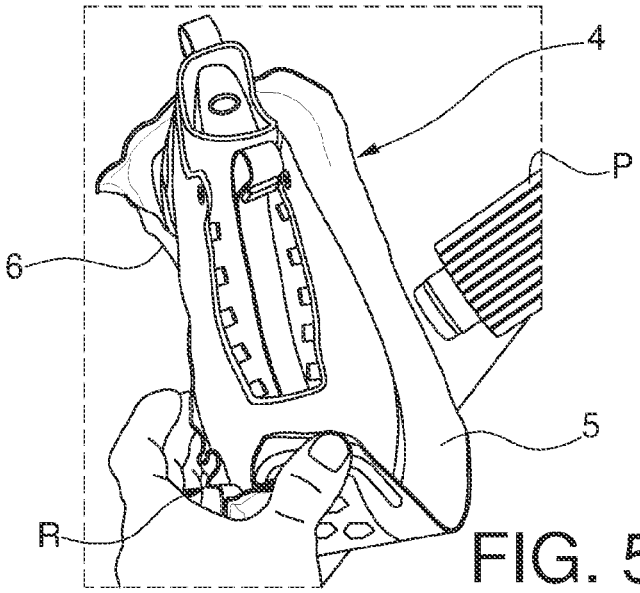
FIG. 5
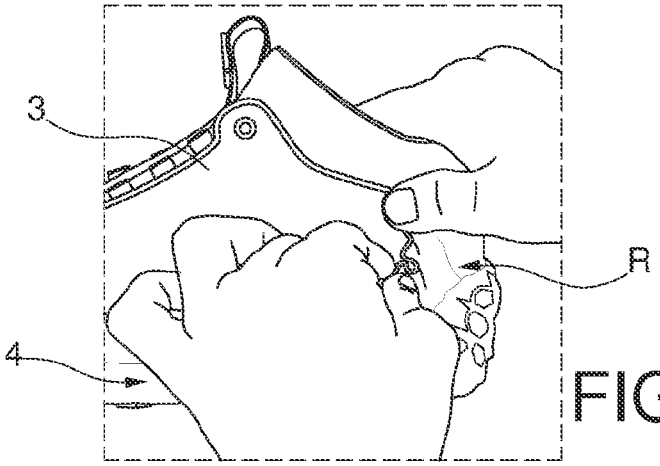
FIG. 6

FIG. 11
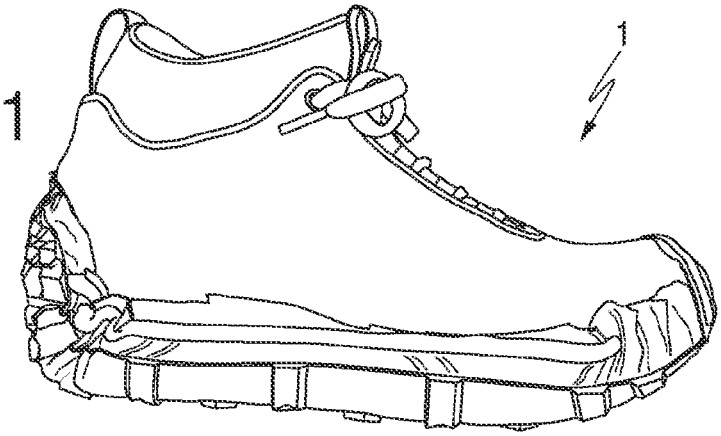
FIG. 12
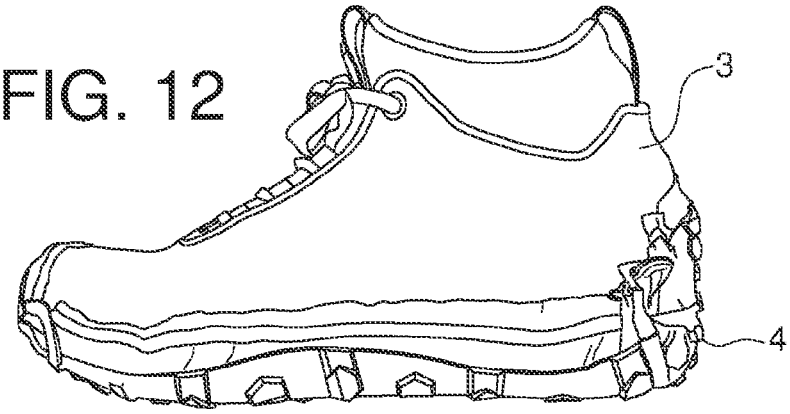
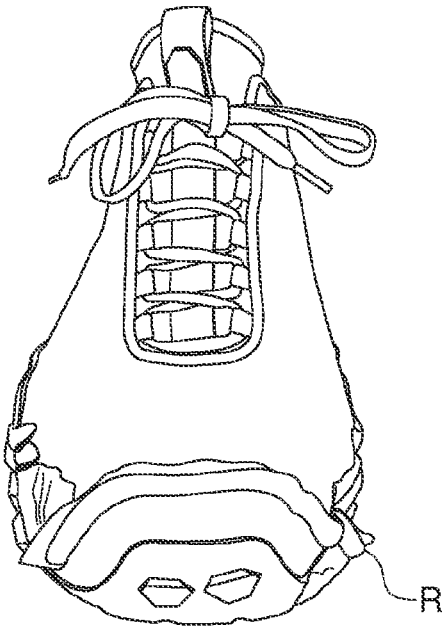
FIG. 13
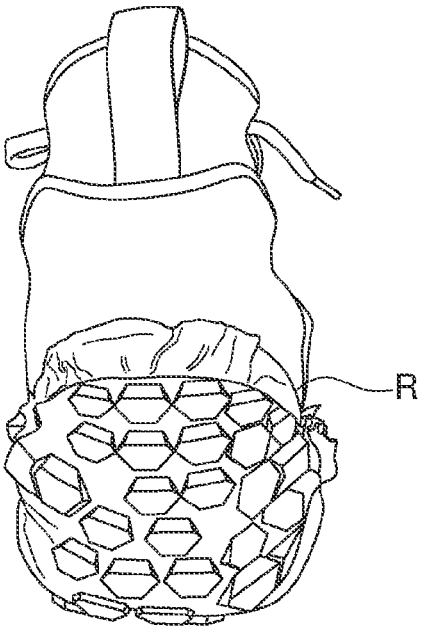
FIG. 14

METHOD CONCERNING THE APPLICATION OF A SOLE OBTAINED BENDING THE EDGES OF A FLAT NON-TRIMMED SOLE ON AN UPPER FOR OBTAINING A SHOE AND A THUS OBTAINED SHOE

TECHNICAL FIELD OF THE INVENTION

The present invention refers to a method for making a shoe provided with a sole extending upward on the sides of the upper by means of the application of a sole that is flat or two-dimensional and non-trimmed, and therefore still provided with a discard edge, and by bending the same on at least one upper; the present invention also refers to the shoe obtained by means of such method.

In particular, the present invention refers to a method which provides for a particular step of assembly of the sole of the shoe in question.

PRIOR STATE OF THE ART

The conventional shoes, present on the market, comprise an upper and can be provided with a flat sole, which is then suitably shaped (milled) according to the shape and size of the upper, or they can be provided with predefined soles (box soles) which have already been designed to be perfectly coupled to the upper.

The upper can be of various type: leather, natural or polymer leather, mesh, made by means of bag structure or strobel structure, or by means of classical method, etcetera.

The sole, usually made of plastic or rubber material, is carded or ground, and then assembled with the upper.

In order to complete this assembly, a glue is applied both to the sole and to the upper, and in the latter the glue is applied in the entire area that will be covered by the sole itself. For such purpose, a maximum point is indicated on the upper, also termed highest point of the upper, up to which the glue will be applied. All this area will be covered by the sole.

Conventional soles, in fact, have a zone that is in contact with the ground and zones which extend upward (or lifts), usually at the tip portion and/or at the heel, and possibly also at the lateral zone of the sole itself. These lifts are obtained with this shape and with such position after molding and finishing, and such lifts are already shaped when they are connected to a relative upper.

After the possible activation of the glue, usually sole and upper are placed superimposed on each other, covering with the sole or with the parts thereof that re extended upward (or lifts) the line or points previously indicated on the upper; then, one proceeds by means of pressing in presses, either piston presses or vacuum presses, for example provided with membranes supplied with oil or water.

In this manner, shoes of standard type are obtained, in which the shape and the characteristics both of the sole and of the upper are defined before their manufacturing. Hence, in order to adapt box soles to shoes of different shape, ad hoc molds are necessary for each shoe shape.

At the same time, the soles thus made must precisely meet the shape requirements of the upper and of the final shoe that one wishes to obtain.

Therefore, there is the need for new soles and/or shoes which allow a greater flexibility in terms of comfort and/or aesthetic selections, and which facilitate the production process both in terms of molds and in terms of reduction of discard material, as well as of the number of manufacturing steps.

SUMMARY OF THE INVENTION

One object of the present invention is to improve the prior state of the art.

Another object of the present invention is to provide a method for making a shoe which uses a non-trimmed sole (and hence still provided with processing burr/discard), which is flat or substantially two-dimensional, with the three-dimensional shape of uppers of different type and simultaneously reducing the number of molds—and the complexity thereof—necessary for making shoes of many different types.

A further object of the present invention is to provide a method for making a shoe which allows inexpensively having a unique design, different from shoe to shoe, reducing or eliminating the discards of the molding of the sole itself.

A further object of the present invention is to provide a method for making a shoe which allows varying the shape of the sole in terms of comfort.

According to one aspect of the present invention, a method is provided for making a shoe according to the present application.

A further object of the present invention is to use the discard edge, which has random shape and thicknesses, in order to provide a shoe having a unique design, different from shoe to shoe, provided with a sole according to the present invention.

A further object of the present invention is to provide a shoe which allows varying the shape of the sole in terms of comfort and technical nature.

The present application refers to preferred and advantageous embodiments of the invention.

BRIEF DESCRIPTION OF THE DRAWINGS

The characteristics of the invention will be better understood by every man skilled in the art based on the following description and on the enclosed drawing tables, provided as a non-limiting example, in which:

FIG. 1 shows a perspective view of a component or sole of the shoe according to the present invention, FIG. 2 shows a perspective view of the various components of the shoe according to one version of the present invention, FIG. 3 shows a step of the method according to one version of the present invention, FIG. 4 shows a further step of the method according to the version of the present invention pursuant to FIG. 3, FIG. 5 shows a further step of the method according to the version of the present invention pursuant to FIGS. 3 and 4, FIG. 6 shows a detail of one step of the method according to one version of the present invention, FIG. 11 shows an outer side view of the shoe according to the present invention, FIG. 12 shows an inner side view of the shoe according to the present invention, FIGS. 13 and 14 respectively show a front view and a rear view of the shoe according to the present invention.

DETAILED DESCRIPTION OF THE INVENTION

Figure 7:
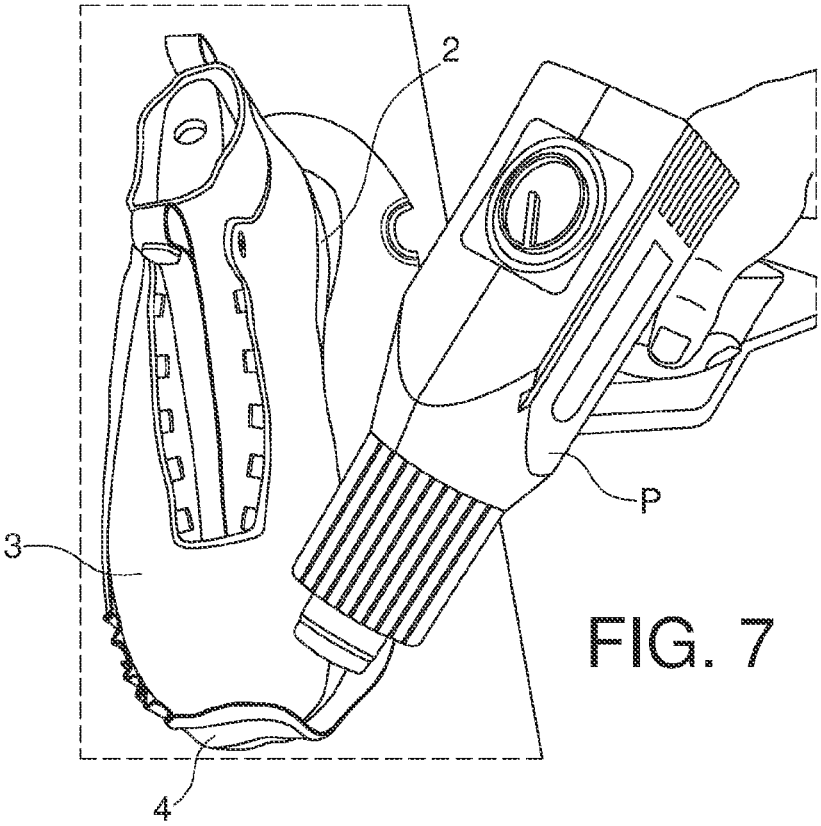
FIG. 7 shows a further detail of one step of the method according to one version of the present invention.
Figure 8:
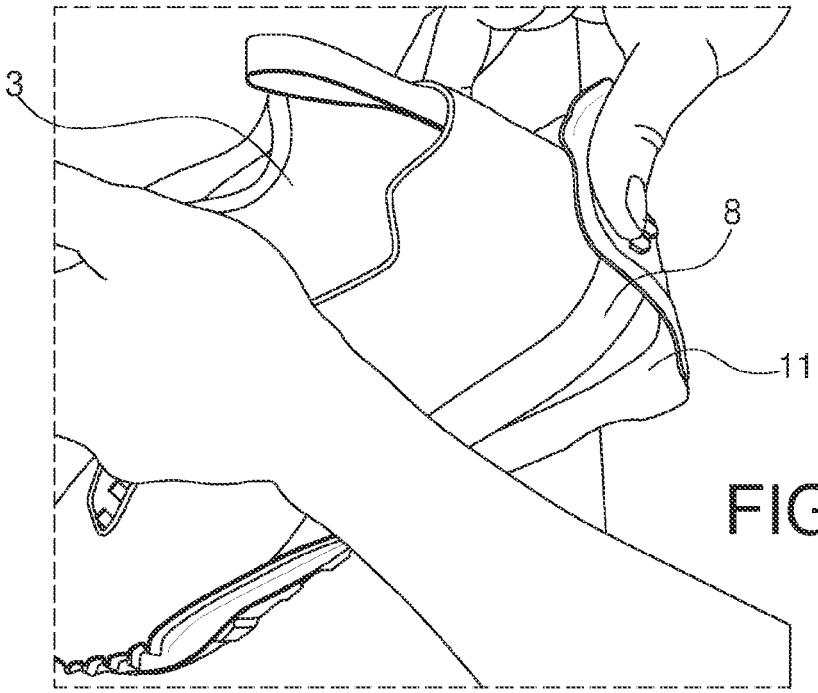
FIG. 8 shows a detail of a step of the method according to one version of the present invention.

The shoe according to the present invention is indicated overall with the reference number 1 in the enclosed drawings.

The shoe 1 in particular is a sport shoe, e.g. running shoe or gym shoe in general, or hiking boot or work boot. The shoe 1 according to the present invention can also be used for leisure time or for every day, or it can be a casual shoe.

The shoe 1 comprises at least one sole 4 and an upper 3.

The sole 4 is a non-trimmed sole.

The fact that the sole 4 is a non-trimmed sole, as will be explained hereinbelow, signifies that it comprises an edge portion constituted by the processing burr or discard, which is made following the molding of the sole itself. The use of the processing burr/discard or edge portion of the non-trimmed sole 4 is innovative in the present invention, according to which such portion renders a substantially flat sole three-dimensional. This burr/discard processing, with shape, size and thickness that are uncontrolled and are irregular, is normally trimmed and discarded.

Therefore, when a non-trimmed sole is indicated in the following description, it will be intended the sole 4 according to the preceding definition.

Therefore, before constraining the sole 4 to the upper 3, no step is provided for trimming or eliminating the processing burr or discard.

The shoe may (or may not) comprise an intersole or wedge 2.

During the present description, the word "bottom" refers to a surface or element usually directed towards the ground or adapted to come into contact with the ground.

The word "upper" refers to a surface or element usually directed opposite the ground or oriented towards a direction opposite the ground.

With "longitudinal", it is intended an axis or a direction from the tip to the heel of the shoe while "transverse" indicates an axis or a direction perpendicular to that longitudinal, i.e. from the right side towards the left side of the foot inserted in the shoe 1.

As is for example visible in FIG. 1, the non-trimmed sole 4 initially has a substantially sheet-like or plate-like shape, having a planar shape that is substantially oval or irregular.

The non-trimmed sole 4, therefore, does not have—in a first manufacturing step—a three-dimensional shape. This is obtained from a sheet, substantially two-dimensional (in order to distinguish it from the classic soles which are constrained to the upper when they already have a specific shaped three-dimensional form) which comprises a central part or impression 9, intended to be coupled with the upper on one side and come into contact with the ground on the other side, and a residual processing edge with irregular form that will be bent upward, enclosing at least part of the upper.

The non-trimmed sole 4 comprises a first surface 5, adapted during use to face and/or be constrained to the upper 3 (with particular reference to its bottom portion, placed during use below the sole of the user's foot) or to the intersole or wedge 2 (when present), and a second surface 6, adapted during use to face towards the ground.

The second surface 6 of the non-trimmed sole 4, in at least one version of the invention, has design or tread 30, so as to ensure and/or increase the grip on the ground.

The planar extension of the non-trimmed sole 4 is greater than the extension of the sole of the user's foot and/or of the bottom 7 of the intersole or wedge 2 (when present).

The object of the non-trimmed sole 4, in fact, is that of being bent upward and enclosing part of the upper 3 and/or the intersole or wedge 2, including—in at least one version of the invention—its lateral surface 8, and being connected to part of the upper 3, so as to obtain the shoe 1 according to the present invention.

In at least one version of the invention, the non-trimmed sole 4, at its first surface 5, can have a central part or impression 9.

The central part or impression 9, which has an extension corresponding to or slightly greater than that of the sole of the user's foot and/or of the bottom 7 of the intersole or wedge 2, has a stylized form substantially corresponding to that of the foot of the user and/or of the bottom 7 itself.

The central part or impression 9 is present in the central zone of the non-trimmed sole 4 and/or of the first surface 5.

Around the central part or impression 9, the non-trimmed sole 4 has, as stated above, an edge portion 11.

The edge portion 11 is extended perimetrically with respect to the non-trimmed sole 4. The edge portion 11 has a substantially flat and annular shape, which is extended starting from the perimeter of the central part or impression 9. The edge portion 11, in fact, having been obtained as a discard of the molding processing, has an irregular shape and/or thickness.

In one version of the invention, the central part or impression 9 and the edge portion 11 are integrally made, to form the non-trimmed sole 4.

The method according to the present invention for coupling the non-trimmed sole 4 to the upper 3 and hence for attaining the shoe 1 comprises at least some of the following steps:

- providing an upper 3,
- providing a non-trimmed sole 4, provided with a central part or impression 9 and with an edge portion 11, in which said non-trimmed sole 4 has a flat and/or sheet like shape, comprising a first surface 5, adapted during use to face towards the upper 3, in which said step of providing a sole 4 comprises molding the central part or impression 9, with consequent formation of the edge portion 11 outside the central part or impression 9, in which the edge portion 11 has a substantially irregular shape and/or forms a molding burr or discard of the sole 4,
- positioning the upper 3 on the first surface 5 of the non-trimmed sole 4 substantially at the central part or impression 9,
- moving the non-trimmed sole 4 and/or the edge portion 11 so to enclose at least part of the upper 3,
- constraining such non-trimmed sole 4 to at least part of the upper 3 so as to obtain the shoe 1.

Such enclosing step comprises bending the edge portion 11 so as to cover at least part of the upper 3.

As specified in the present description, the edge portion 11 is constituted by a processing burr or discard and has an irregular shape, size and/or thickness, caused by the step of molding the sole 4.

In particular, the surface of the edge portion 11 that comes into contact with the upper 3 corresponds with part of the first surface 5 of the non-trimmed sole 4.

The part of the edge that remains outside or visible, of the non-trimmed sole 4 of the shoe 1, is that corresponding with the second surface 6.

The constraining step, in at least one version of the invention, comprises at least one of the following steps: delineating, on the upper 3, a maximum line 13 below which a glue is applied, applying a glue at the upper 3 (below the maximum line 13—such applying occurs in the part of the upper present in plan view and laterally below the maximum line 13 or, in the presence of intersole or wedge 2, at its bottom portion) and at the non-trimmed sole 4.

If an intersole or wedge 2 is present, the method according to the present invention comprises the following steps:

- providing an intersole or wedge 2, constraining the intersole or wedge 2 to the upper 3 (at least perimetrically),
- enclosing the non-trimmed sole 4 around the intersole or wedge 2, in a manner so as to cover the bottom 7 thereof and its lateral surface 8,
- constraining the non-trimmed sole 4 to the intersole or wedge 2, as well as to the upper 3.

If such constraining step occurs by means of gluing, there is also a step of applying a glue to the intersole or wedge 2 and/or to the bottom 7 and/or to its lateral surface 8.

In such case, the extension of the edge portion 11 is such to allow covering, by means of the enclosing step, at least the lateral surface 8 and/or the bottom 7 of the intersole or wedge 2 and/or at least one portion of upper 3.

In one version of the invention, the non-trimmed sole 4 is carded or ground and/or treated with primer so as to improve the adhesion of the glue.

The glue which is used is of conventional type, such as a polyurethane glue, a neoprene glue, an acrylic glue etcetera.

According to a further version, the enclosing step and the constraining step can be carried out manually or by means of suitable machines.

For example, it is possible to position the non-trimmed sole 4 and the upper 3 (possibly with the interposition of the intersole or wedge 2) in a machine such as for example a press. In such a manner, by means of mechanical arms, possibly automated, and/or by means of application of vacuum to such machine and/or press, the edge portion 11—upon treatment with suitable primer and spreading of suitable glue on the non-trimmed sole 4 and/or on the possible intersole or wedge 2 and spreading of suitable glue on the part of the upper 3—is lifted and enclosed around the upper 3 (and possible around the bottom 7 and lateral surface 8 of the intersole or wedge 2) and is constrained thereto.

In a still further version, such steps of enclosing and constraining can be attained by means of thermoforming the non-trimmed sole 4 (made of a suitable thermoformable material and/or a foam material) on at least part of the upper 3 and/or of the possible intersole or wedge 2. In such case, such thermoforming step can occur on a suitable machine or mold and/or on a suitable shaped component which mimics the user's foot, so as to determine the size and/or shape of the shoe 1

After the glue application step, and possibly during the step of enclosing the non-trimmed sole 4, a glue activation step may be carried out.

Such step can occur by means of heat and/or infrared rays, for example by bringing the glue and/or the upper 3 and/or the non-trimmed sole 4 to a temperature of 70° C. Such step can take place in a suitable furnace and/or locally by means of a suitable portable or fixed heater device P, possibly mechanized or automated, e.g. like a hairdryer.

During the enclosing step, the edge portion 11 is applied to at least part of the upper 3 and, if present, to the lateral surface 8 and to the bottom 7 of the intersole or wedge 2.

Such enclosing, beyond the application of the non-trimmed sole 4, can involve a bending and/or curling of the edge portion 11 itself, especially in the curved zones of the shoe 1. Such bending and/or curling can involve the formation of at least one curling zone R of the non-trimmed sole 4 on the upper 3.

According to a possible application mode, when the intersole or wedge 2 is present, after having positioned and constrained the bottom 7 substantially at the central part or impression 9 of the non-trimmed sole 4, initially the edge portion 11 is enclosed around and applied to the upper 3, such edge portion present at a front zone or tip of the shoe. Such passage is for example visible in FIG. 3, which illustrates the step of heating and/or activating the glue of the tip zone of the shoe itself. FIG. 4 illustrates the positioning of the corresponding edge portion 11 of the non-trimmed sole 4 on the tip zone of the shoe 1.

Subsequently, one can proceed with the application of the zone of the edge portion 11 placed at a rear zone or heel of the shoe or with one of the lateral portions thereof.

For example, in FIG. 5, it is seen that, at the curved zone of the shoe, the edge portion 11 of the non-trimmed sole 4 is curled and/or bent, so as to form a curling zone R.

Such curling zone R is also present at the portion of the heel of the shoe 1, as is visible for example in FIG. 6. In the version of FIG. 6, for example, the intersole or wedge 2 might not be present.

FIG. 7 illustrates another possibility of application of the non-trimmed sole 4 on the upper 3, in which the portion at the tip and at the lateral section have already been applied, while one is preparing to proceed with the placement of the other lateral portion (or medial portion) and of the heel.

As can be understood, the step of heating and/or activating the glue can be repeated and can occur locally, depending on the requirements and on the portion of non-trimmed sole 4 that must be applied.

Figure 9:
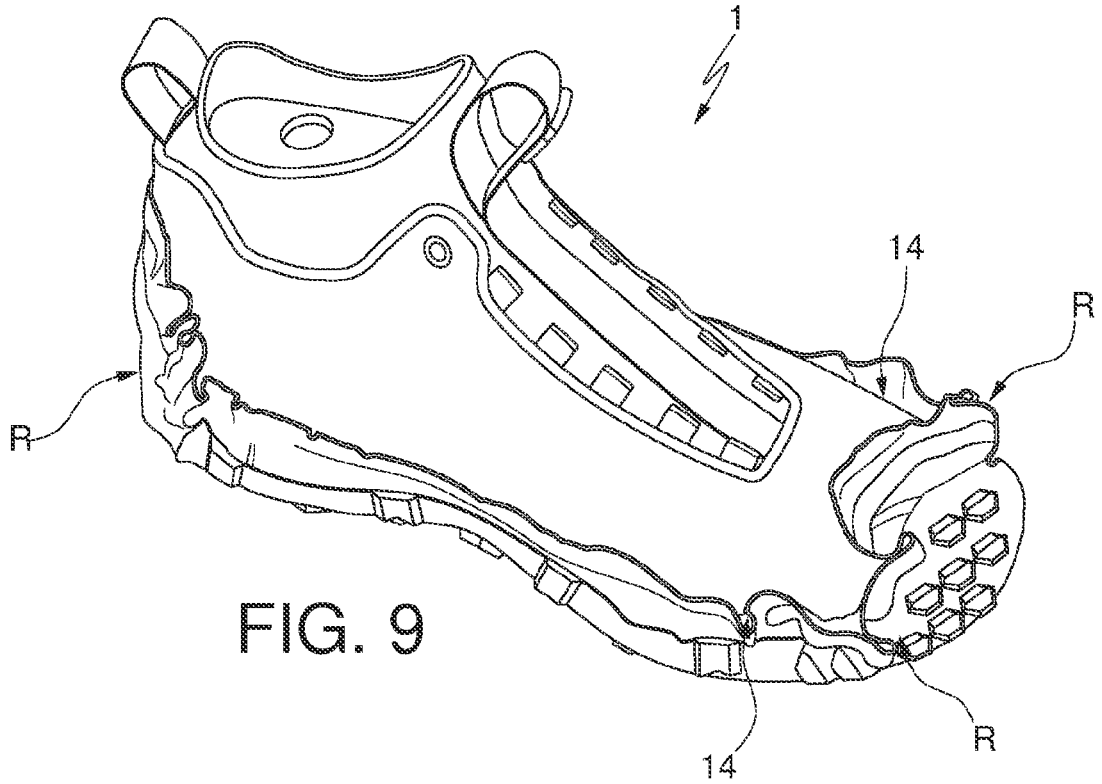
FIG. 9 shows a perspective image of the shoe in one step of the method according to one version of the present invention.

The shoe 1 according to at least one version of the present invention, obtained by means of the steps of the above-described method, is for example depicted in FIG. 9. As can be appreciated, several curling zones R are present, and the non-trimmed sole 4 assumes a unique design on the upper 3, different from shoe to shoe.

In one version of the invention, in fact, such steps take place manually, and this contributes to rendering each shoe different.

Figure 10:
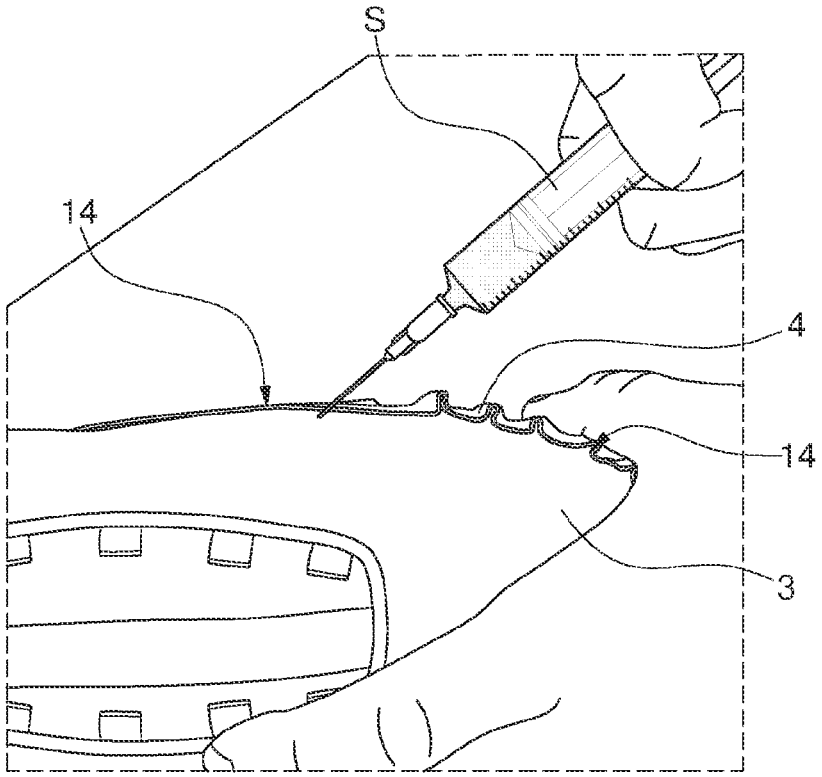
FIG. 10 shows a further step of the method according to one version of the present invention.
Figure 15:
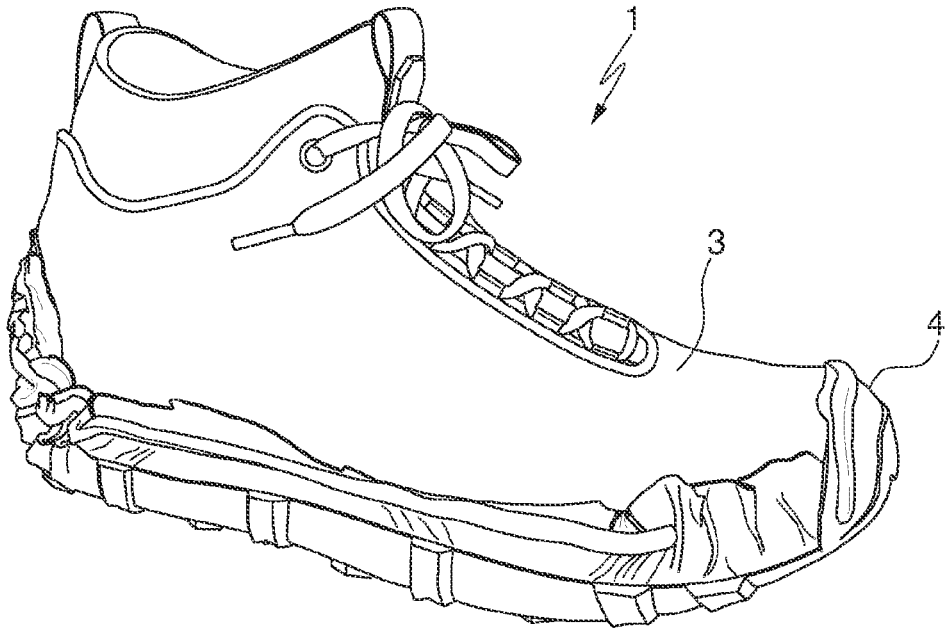
FIG. 15 shows a perspective view of the shoe according to the present invention.

FIG. 10 illustrates another possible step of the method according to which, by means of a suitable instrument such as a syringe S, possible empty spaces or openings 14 are filled with glue (or with another suitable material); such empty spaces or openings could have been formed after the application of the non-trimmed sole 4 on the upper 3. These empty spaces or openings 14, if present, are positioned between the upper 3 and the non-trimmed sole 4, for example at least one curling zone R.

In this manner, such empty spaces or openings 14 cannot form an access for moisture, dust or other external elements, which could cause damage to the shoe or the separation of the non-trimmed sole 4.

Naturally, the manual filling processing can be substituted by an automated process carried out by vacuum machines or other types of devices.

Such non-trimmed sole 4, at the end of the manufacturing process, constitutes the actual external sole of the shoe 1.

Indeed, the second surface 6 of the further non-trimmed sole 4 can have a suitable tread 30 in order to facilitate the grip on the ground and/or in order to facilitate the athletic performance for which the shoe 1 is ideated.

In addition, the second surface 6, at the edge portion 11, can also bear designs and/or grooves and reliefs as in the tread 30, but the margins, the shape and the thickness of these remain irregular (since, as stated above, the edge portion 11 in fact constitutes a processing discard).

A great advantage of this type of shoe and of this method lies in the fact that the discards are completely reduced. In fact, as stated above, by ideally following a manufacturing method of conventional type, the edge portion 11 would constitute the so-called processing/molding burrs of the material that constitutes the non-trimmed sole 4 and/or the central part or impression 9—and this would have therefore been trimmed and eliminated from the finished sole before proceeding with its application to the upper for the obtainment of a shoe. Instead, due to the present invention, such trimming step does not take place and the material which is usually discarded (such processing/molding burrs) is maintained and rather forms the non-trimmed sole 4 and, at least in one version of the invention, the unique design of the shoe 1 according to the present invention.

Hence, in such a manner, a flat or substantially two-dimensional sole, such as the non-trimmed sole 4, is rendered three-dimensional by means of the steps of enclosing and constraining to the upper 3. In such a manner, it is possible to use a simple and light mold, relatively inexpensive, for molding the flat non-trimmed sole 4. Such flat non-trimmed sole 4 is then adapted to be applied to a high number of uppers, for making shoes with shape and/or size that are even quite different from each other.

On the contrary, according to conventional methods, since the soles to be applied to the uppers already have, as stated above, a sole shaped in a three-dimensional manner or so-called box sole, they must be made from specific molds, much more complex than those which serve for carrying out the molding of the non-trimmed sole 4, and in particular each shoe shape has a sole made from a specific mold. In addition, with regard to the conventional box soles, these are made with a deeper and heavier mold, which is made with a greater quantity of metal. In addition, in order to attain the final product, the processing/molding burrs must be eliminated from the conventional sole in the trimming step. These constitute a waste of material (i.e. the greater quantity of metal necessary for making a 3D mold and the burrs that are eliminated)—this disadvantage is overcome by means of the present invention, which also provides for a lower number of processing steps for obtaining the shoe 1.

Unlike the prior art, the non-trimmed sole 4 according to the present invention is adapted to many types of shoes, also with shapes very different from each other.

In addition, due to the present invention, the non-trimmed sole 4 also serves for positioning, between the non-trimmed sole 4 itself and the upper 3, a possible intersole or wedge 2. In such a manner, the non-trimmed sole 4—being a true external sole and also laterally extending upward on at least part of the upper 3—protects that which is positioned at its interior.

Indeed, in at least one version of the invention, the non-trimmed sole 4 and/or the edge portion 11 covers at least part of the upper 3 along the entire perimeter of the user's foot, also ensuring a greater protection to the latter.

Therefore, the relative enclosing step comprises moving the non-trimmed sole 4 so to enclose at least part of the upper 3 (considering that this part is considered height-wise, i.e. to include edge portions 11 which extend upward more or less on the upper 3), but along the entire perimeter of the foot which during use is inserted within the shoe and/or within the central part or impression 9.

In the same manner, the shoe 1 can comprise at least one insert, positioned between the non-trimmed sole 4 and the upper 3 before the connection of the latter to the non-trimmed sole 4 itself.

The intersole or wedge 2 or the at least one insert can be made of material different from those of conventional soles, such as for example a material that is not abrasion resistant, a soft material, a light material, a material suitable for conferring comfort and/or lightness, such as a foam material, ethyl vinyl acetate (EVA), polyurethane, polystyrene, expanded thermoplastic polyurethane (TPU), a polyether and amide copolymer such as a material known with the commercial name Pebax foam, or a more rigid material, such as an anti-pronation material, a thermoplastic material, TPU, Pebax, nylon, a material filled with carbon fibers, glass fibers, etcetera, a natural material such as cork, a non-impermeable material, etcetera. Indeed, the characteristics of abrasion resistance, impermeability, seal, etcetera, are conferred by the material of the non-trimmed sole 4. It is such non-trimmed sole 4, indeed, to be made by means of the materials which only constitute an external sole, and hence the intersole or wedge 2 (which during use is situated inside and protected by the non-trimmed sole 4) can perform different functions, e.g. they can have properties of comfort, damping, lightness, etcetera.

In the same manner, the intersole or wedge 2 or the at least one insert can be made so as to confer a specific technical nature to the shoe 1. In particular, these can be made with a structure or with characteristics tied to the athletic performance or to the sport to which the shoe, in at least one version of the invention, is dedicated. For example, the intersole or wedge 2 or the at least one insert can comprise elements and/or parts that are more rigid than the rest of the structure, air chambers and/or cushioning or damping elements, also inflatable, electrical or pneumatic components or sensors, such to render the shoe 1 a so-called smart-sole, etcetera. Such components can be positioned within the intersole or wedge 2, and/or preferably at the heel, due to the greater thickness of the intersole or wedge 2 present in such zone.

With respect to conventional shoes, in the presence of air chambers or damping elements, these can be damaged with use or be perforated, losing the comfort and damping properties. This does not occur with the present invention, since the non-trimmed sole 4 also laterally protects that which is present at its interior.

In the case of the present invention, thereof, such at least one insert is covered and enclosed by the non-trimmed sole 4 during use, and therefore it is more protected from the wear and abrasion caused by the use of the shoe 1.

Naturally, it is also possible that the intersole or wedge 2 and/or the at least one insert can be made of the same material as the non-trimmed sole 4, depending on the requirements.

The non-trimmed sole 4 can have a thickness as slender as 0.5 mm, such that it can be easily shaped during the attainment method according to the present invention.

In any case, the tread 30 could also have a considerable thickness (for example the thickness of a nailed sole for a mountain boot), while the edge portion 11—even if slender in order to be bent (and hence in the part which is bent, at about the zone close to the tread 30 and/or to the central part or impression 9)—could, in at least one version, be thicker and/or knotted in the outer margin.

The non-trimmed sole 4 can have the same thickness or the edge portion 11 can be thinner while the central part or impression 9 can be thicker, in accordance with the specific use.

The non-trimmed sole 4 and/or the central part or impression 9 can be, in one version of the invention, reinforced with a suitable material or fabric. In such a manner, a thin and strong sole is obtained, since in addition to the materials that usually make up the sole, it contains and/or is reinforced with fibers of various type (e.g. nylon fibers, glass fibers, metal fibers, plant fibers, mixtures thereof, etcetera).

In such a manner, it is possible to reduce the weight and/or the thickness of the non-trimmed sole 4, while maintaining unchanged the characteristics of an external sole of conventional type.

In at least one version of the invention, the fibers of the fabric can have greater extension than that of the impression 9 and/or of the edge portion 11, and extend upward on at least part of the upper in order to be joined therewith.

The non-trimmed sole 4 of the shoe 1 is usually made of rubber material or of polyurethane material (PU) or of thermoplastic polyurethane (TPU) or of other suitable materials.

The non-trimmed sole 4 can be made, for example, of one of the following blends:

blend based on (and/or whose main component is) a natural rubber, a synthetic rubber (including a nitrile rubber, butyl rubber, polyisoprene rubber, polybutadiene rubber, SBR), a mixture thereof, etcetera.

The upper 3 can be of many different types: leather, natural or polymer fabric, mesh, attained by means of bag structure or stroebl structure, or by means of classic method, etcetera. If the upper 3 has a bag structure, it comprises an actual portion of upper as well as—made of the same material—a bottom portion which is adapted to cover the underlying part or sole of the foot, so as to form a kind of suitably-shaped bag. The bag-like upper, in at least one version of the invention, is made of a single piece or by means of assembly (e.g. by means of stitching or casting or gluing) of two or more parts, so as to make the upper with complete bag. In a further version, the upper 3 can be connected, at least peripherally (e.g. by means of stitching), to an intersole or wedge 2. In such case, the upper can have a bag structure (like that described above) or a classic structure, in which the lower perimeter edge of the upper is constrained or stitched or fixed to the perimeter of the intersole or wedge 2.

In such case, an insole may be present or not present, placed between the intersole or wedge 2 and the sole of the user's foot.

The intersole or wedge 2 can usually be made of plastic or rubber material, and it can be carded or ground, and then assembled to the upper 3. The intersole or wedge 2, in one embodiment of the invention, is preformed.

The intersole or wedge 2 has a shape substantially corresponding to the sole of the foot and its external perimeter substantially corresponds to the external perimeter of the user's foot.

The intersole or wedge 2 has a bottom 7 and a lateral surface, substantially annular, indicated with 8.

The lateral surface 8 is extended along the entire perimeter of the intersole or wedge 2 and has a lower height at the tip of the shoe 1, and a greater height at the zone of the heel of the shoe 1 itself.

In at least one version of the invention, the lateral surface 8 and/or the bottom 7 is smooth.

The shoe 1 and/or the upper 3 also comprises an opening 24, through which the user inserts the foot within the shoe 1; tightening means can be present that are capable of closing the shoe and/or rendering it adherent to the user's foot.

FIGS. 11 to 15 show various views of the shoe 1, resulting from the above-indicated method.

Figure 16:
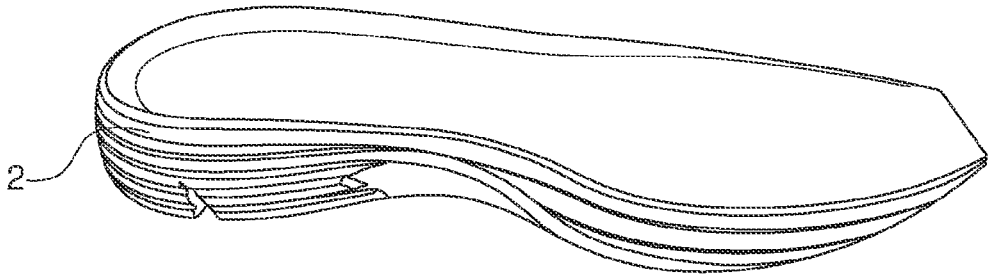
FIG. 16 shows a view of a component (or intersole or wedge) of the shoe according to the present invention.

Finally, FIG. 16 represents the intersole or wedge 2 which can be positioned inside the shoe 1 according to the present invention.

Figure 17:
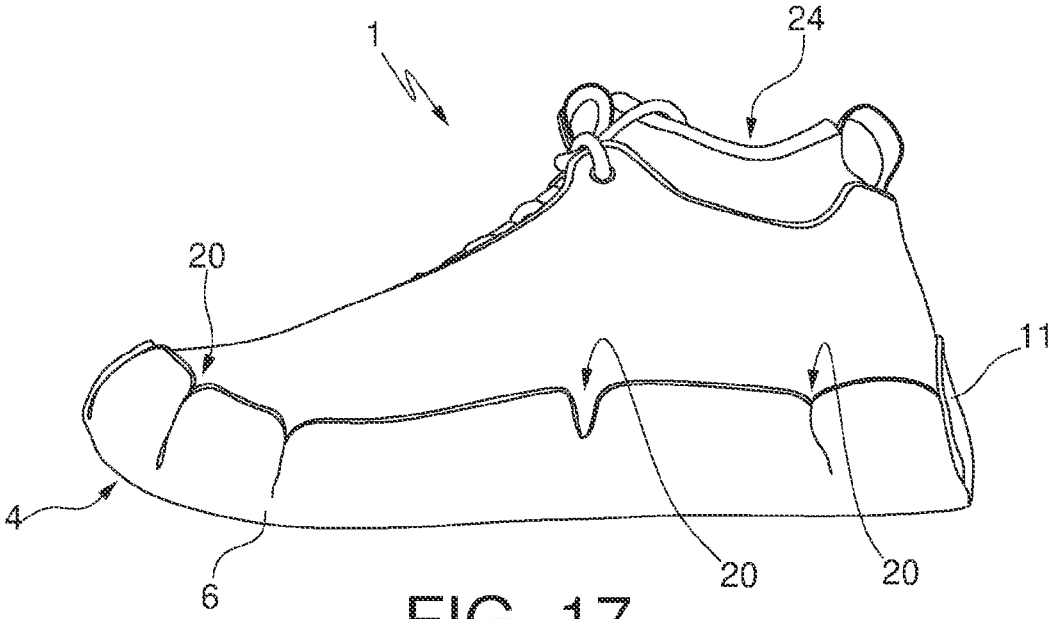
FIG. 17 shows a side view of a shoe according to one version of the present invention.
Figure 18:
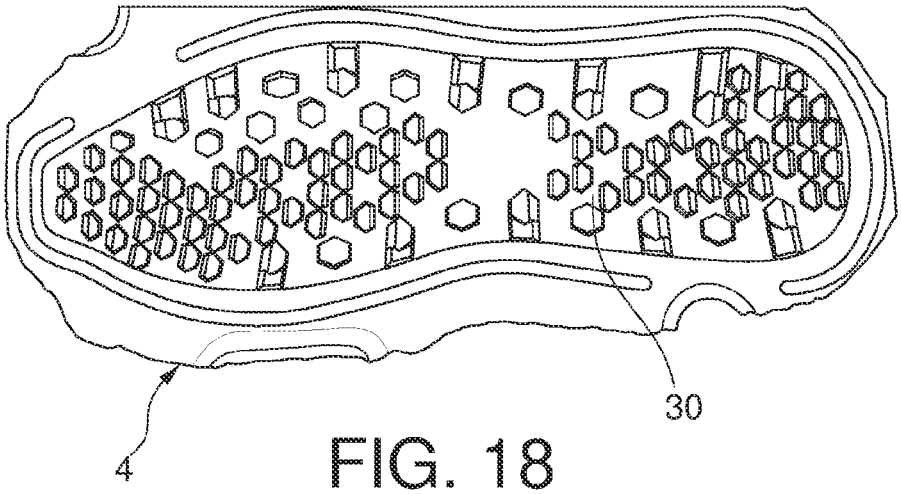
FIG. 18 shows a bottom view of the shoe or of the sole according to one version of the present invention.

FIG. 17 illustrates a further version of the present invention, in which the non-trimmed sole 4, in particular its edge portion 11, has notches 20. Such notches 20, which serve for facilitating the enclosing and/or the bending of the non-trimmed sole 4 on the upper 3, can have a progression which is substantially extended from the central part or impression 9 towards the exterior of the non-trimmed sole 4. These notches 20 have a substantially triangular or vertical or tilted shape, possibly with vertex at the central part or impression 9. Preferably, according to at least one version, the notch 20 and/or its vertex does not reach the central part or impression 9 but has a little more limited extension, so as to maintain an edge joined at the zone of the non-trimmed sole 4 in proximity to the ground.

This is in any case a stylized image since such notches 20, with regard to shape and thickness, are irregular, as the edge portion on which they are made is also irregular.

Therefore, it is seen that for the shoe 1 the external sole is obtained starting from a non-trimmed or substantially two-dimensional sole 4; such external sole is attained by means of the particular method of the invention and in particular by means of the step of moving such non-trimmed sole 4 so to enclose an upper. The external sole of the shoe 1, therefore, has a three-dimensional effect in which the particular geometric figures can be, in at least one version of the invention, unique and different for each shoe.

As an alternative, the non-trimmed sole 4 and/or the edge portion 11 can be shaped such to assume a form so as to facilitate enclosing around at least part of the upper 3, in a manner so as to create a more precise bending and reduce the curling zones R or make them more regular and standard, also suitable for a production of industrial type.

The non-trimmed sole 4 according to the present invention, therefore, is not trimmed and the method according to the present invention does not comprise trimming steps.

The present invention, in fact, uses that which usually is a discard portion in order to make the edge portion 11, hence the part of non-trimmed sole 4 which extends upward on the upper 3 along the entire the perimeter of the user's foot and/or of the impression 9.

The invention thus conceived is susceptible of numerous modifications and variations, all comprised in the scope of the inventive concept.

In addition, the characteristics described for one embodiment of the invention can therefore be present in other embodiments, without departing from the protective scope of the present invention.

In addition, all the details can be substituted with other technically equivalent elements. In practice, all the materials employed, as well as the contingent shapes and sizes, can be of any type in accordance with the requirements, without departing from the protective scope of the following claims.

What is claimed is:

1. A shoe comprising:

an upper having a perimeter;

a sole comprising a central part and a mold burr, wherein the mold burr comprises an edge portion which perimetrically extends from said central part;

wherein said edge portion covers, encloses and is affixed along at least part of the perimeter of said upper, wherein the edge portion is affixed by folding the edge portion over itself to form curling Zones® comprised of overlapped foldings comprising indentations and protrusions having openings, wherein said openings are filled with glue.

2. The shoe according to claim 1, wherein said sole comprises a non-trimmed sole comprising a first surface, during use adapted to face towards said upper, and a second surface, during use adapted to face towards the ground.

3. The shoe according to claim 2, wherein said second surface has a design or tread, so as to ensure and/or increase the grip on the ground.

4. The shoe according to claim 1, wherein said curling Zones® are placed at curved zones of said shoe.

5. The shoe according to claim 1, wherein it comprises an intersole having a bottom and a lateral surface, said intersole being placed between said sole and said upper; wherein said edge portion of said sole covers, encloses and is applied over at least part of the lateral surface of said intersole.

6. The shoe according to claim 1, wherein said sole is constrained to said upper and wherein said central part is constrained to a bottom portion of said upper.

7. The sole according to claim 5, wherein said central part of said sole is constrained to said bottom of said intersole, wherein said sole is placed externally with respect to said intersole and with respect to said upper.

8. The shoe according to claim 1, wherein said shoe is an athletic shoe and wherein said upper comprises a material selected from the group consisting of leather, natural fabric, polymer fabric, and mesh.

9. The shoe according to claim 1, wherein said sole has a thickness of 0.5 mm.

10. The shoe according to claim 1, wherein said central part and said edge portion of said sole have the same thickness.

11. The shoe according to claim 1, wherein said edge portion is thinner than said central part of said sole.

12. The shoe according to claim 1, wherein at least one of said sole and/or said central part is reinforced with a material or fabric, or with a plurality of nylon fibers, glass fibers, metal fibers, plant fibers, mixtures thereof, and/or wherein said sole is made of rubber material such as a natural rubber, a synthetic rubber, including nitrile rubber, butyl rubber, polyisoprene rubber, polybutadiene rubber, a mixture thereof, or of polyurethane material (PU) or of thermoplastic polyurethane (TPU).

13. The shoe according to claim 5, wherein said intersole is made of a material selected from the group consisting of a soft material, a light material, a material suitable for conferring comfort and/or lightness including an expanded material, ethylvinylacetate (EVA), polyurethane, polystyrene, expanded thermoplastic polyurethane (TPU), a polyether and amide copolymer, or a rigid material, including an anti-pronation material, a thermoplastic material, TPU, nylon, a material filled with carbon fibers, glass fibers, a natural material, cork, a non-impermeable material, and/or comprising elements and/or parts more rigid than the rest of the structure, air chambers and/or cushioning or damping elements, inflatable elements, or sensors or electrical or pneumatic components.

14. The shoe according to claim 1, wherein the curling zones comprise openings filled with glue.

* * * * *